US005200783A

United States Patent [19]

Maeda et al.

[11] Patent Number: 5,200,783

[45] Date of Patent: Apr. 6, 1993

[54] BLACK IMAGE DENSITY CORRECTING DEVICE

[75] Inventors: Yasutaka Maeda, Ikoma; Katsuhiro Nagayama, Yamatokoriyama, both of Japan

[73] Assignee: Sharp Kabushiki Kaisha, Osaka, Japan

[21] Appl. No.: 750,575

[22] Filed: Aug. 28, 1991

[30] Foreign Application Priority Data

Aug. 30, 1990 [JP] Japan ..... 2-231669

[51] Int. Cl.[5] ..... G03G 21/00

[52] U.S. Cl. ..... 355/246; 118/665; 118/691; 355/208; 355/326

[58] Field of Search ..... 355/208, 214, 246, 326, 355/327; 430/30, 42, 43, 44; 118/665, 691

[56] References Cited

U.S. PATENT DOCUMENTS 4,894,685 1/1990 Shoji ..... 355/246
5,075,726 12/1991 Itaya et al. ..... 355/246
5,083,160 1/1992 Suzuki et al. ..... 355/208

FOREIGN PATENT DOCUMENTS 59-30269 7/1984 Japan .

*Primary Examiner*—Michael L. Gellner
*Assistant Examiner*—Patrick J. Stanzione
*Attorney, Agent, or Firm*—David G. Conlin; Robert F. O'Connell

[57] ABSTRACT

An image density correcting device for a color copying machine capable of producing monochrome copies and full color copies, the device including a toner density detecting means for detecting the toner density of a toner image transferred on a transfer medium; a toner density storing means for storing a predetermined reference value for the toner density; a toner density comparing/judging means for judging the toner density of the image by comparing the toner density detected by the toner density detecting means with the toner density reference value stored in the toner density storing means; and a toner density correcting means for correcting the toner density of the image based on the result of the comparison and judgment by the comparing/judging means, wherein the toner density is corrected after a black toner layer is formed in any non-black color detectable by the toner density detecting means, of areas where black toner layers are formed for monochrome copying with black toner.

9 Claims, 7 Drawing Sheets

BLACK IMAGE DENSITY CORRECTING DEVICE

BACKGROUND OF THE INVENTION

1. Field of the Invention

The present invention relates to a black image density correcting device for use in a full color copying machine capable of producing monochrome copies with black toner.

2. Description of the Prior Art

In a conventional color copying machine, and particularly, in a full color copying machine capable of reproducing original colors, the original is scanned three times to produce a full color copy. That is, in the first scanning, light reflected from the original document is passed through a blue filter to form a latent image on a photoconductor to which yellow toner, the complementary color of blue, is applied for development. In the second scanning, magenta toner is applied to a latent image formed on the photoconductor through a green filter, and finally in the third scanning, cyan toner is applied to a latent image formed through a red filter. The toner images of the above three colors are then transferred one on top of another onto a transfer medium disposed adjacent to the photoconductor, and the thus transferred image is further transferred onto a copy sheet to produce a full color image.

In recent years, full color copying machines provided with a black toner developer tank and capable of producing not only color copies but also monochrome copies with the black toner have come into common use.

In conventional full color copying machines capable of producing monochrome copies with black toner, toner density corrections for production of color copies are performed with respect to the toner transferred to the transfer medium. However, because of the need to electrically transfer toner images in register, carbon is dispersed in the film that forms the transfer medium belt, and therefore, the transfer medium has had a darkened surface of near black. As a result, since black toner is deposited on the black colored transfer medium when making monochrome copies with black toner, it has been difficult to detect the toner density on the transfer medium.

Therefore, in the prior art, the initial toner density has been set to a higher level to ensure production of stable images throughout the life of the developer, thereby eliminating the need for toner density corrections as the toner is consumed. However, this has caused degradation in the quality of initial images.

SUMMARY OF THE INVENTION

The image density correcting device of the present invention, which overcomes the above-discussed and numerous other disadvantages and deficiencies of the prior art, comprises a toner density detecting means for detecting the toner density of a toner image transferred on a transfer medium; a toner density storing means for storing a predetermined reference value for the toner density; a toner density comparing/judging means for judging the toner density of the image by comparing the toner density detected by the toner density detecting means with the toner density reference value stored in the toner density storing means; and a toner density correcting means for correcting the toner density of the image based on the result of the comparison and judgment by the comparing/judging means, wherein the toner density is corrected after a black toner layer is formed in any non-black color detectable by the toner density detecting means, of areas where black toner layers are formed for monochrome copying with black toner.

In a preferred embodiment, the black toner layers for monochrome copying with black toner are formed on the transfer medium, and a pre-toner layer forming means is provided so as to form pre-toner layers with a toner of any non-black color detectable by the toner density detection means at least on the toner density detection areas on the transfer medium, followed by the formation of the black toner layers on the top surface of the pre-toner layers formed with the non-black color toner by the pre-toner layer forming means.

In a preferred embodiment, the black toner layers for monochrome copying with black toner are formed on a transfer roller disposed facing the transfer medium and in a paper transport path extending from a paper feed section to a fixing section and in which at least toner density detection areas are formed in a non-black color detectable by the toner density detecting means.

Thus, the invention described herein makes possible the objective of providing an image density correcting device for a color copying machine in which the toner density detection areas of the black toner formation areas are formed on a background of a non-black color detectable by the tone density detecting means, thereby detecting the toner density easily and accurately when producing monochrome copies with black toner, thus assuring production of monochrome copies of stable image quality with proper image density corrections.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

The preferred embodiments of the present invention will now be described with reference to the accompanying drawings.

Figure 3:
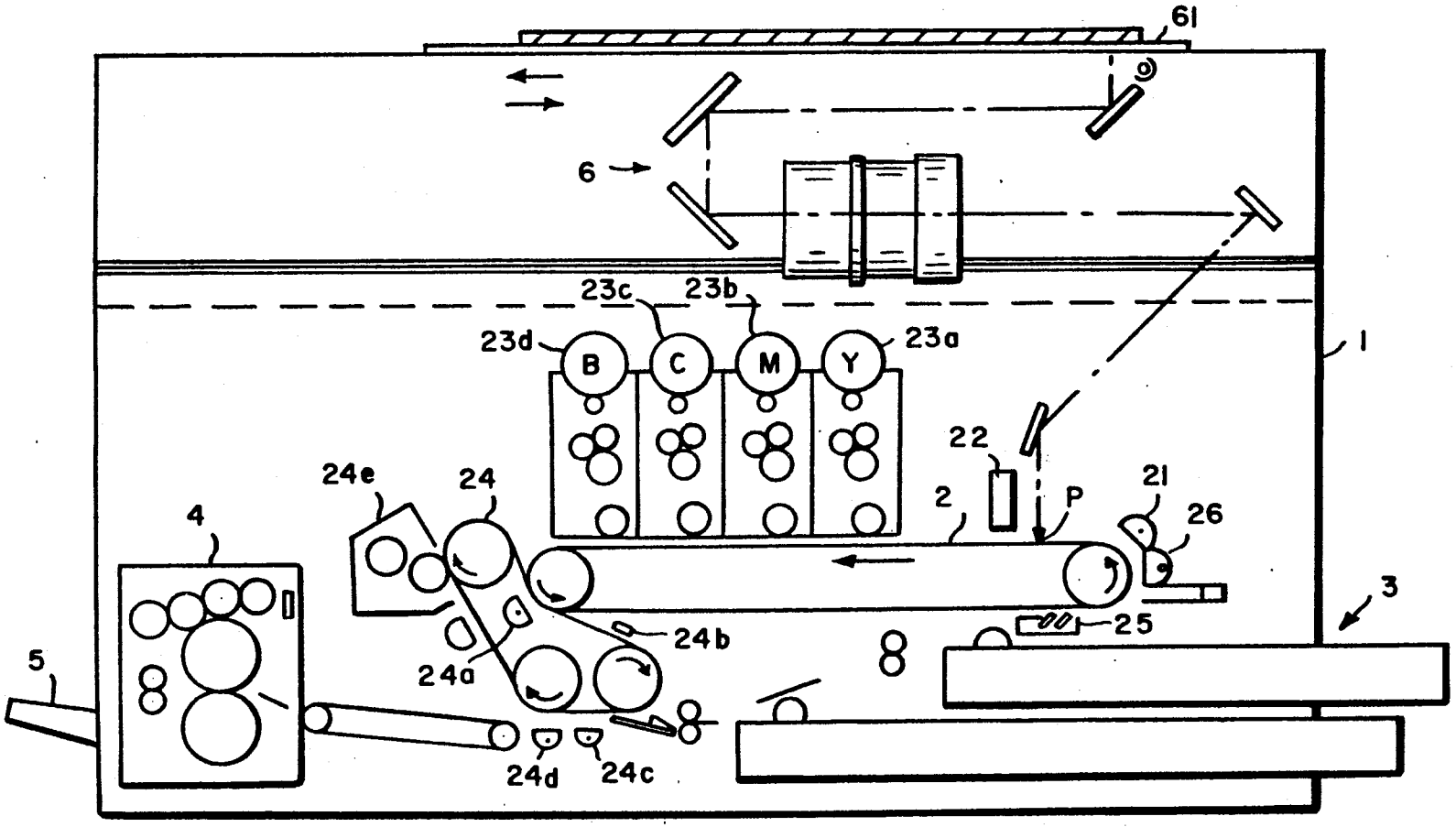
FIG. 3 is a side view showing the structure of a copying machine according to the present invention.

FIG. 3 is a cross sectional view showing the structure of a copying machine in accordance with the present invention.

As shown, in the middle of the copying machine 1, there is disposed a photoconductor 2 in the form of an endless belt passed around two rollers. Disposed around the photoconductor 2 in the rotating direction thereof are a main charger 21, a blank lamp 22, developing devices 23*a*–23*d*, a transfer medium 24, a cleaning device 25, and a discharge lamp 26. The main charger 21 is used to uniformly charge the surface of the photoconductor 2 by means of corona discharge. The charge potential on the photoconductor 2 is adjusted by varying the voltage applied to the charger wire. The blank lamp 22 consists of an LED array extending along the width of the photoconductor 2 and is used to selectively remove the charge on the surface of the photoconductor 2 by selectively illuminating the surface of the photoconductor 2 that has been uniformly charged by the main charger 21. The developing devices 23*a*–23*c* are loaded with yellow, magenta, and cyan toners, respectively, and one of them is used in the test mode for setting the process condition. The cleaning device 25 removes residual toner on the photoconductor 2, while the discharge lamp 26 removes residual charge potential on the photoconductor 2.

A transfer medium 24, which consists of a dielectric sheet passed around three rollers, rotates at the same speed as the surface speed of the photoconductor 2. The photoconductor 2 is pressed against the transfer medium 24 at a position adjacent to a first transfer charger 24*a* so that the toner on the photoconductor 2 is transferred to the transfer medium 24. Disposed around the transfer medium 24 in the rotating direction thereof are a second transfer charger 24*c*, a separation charger 24*d*, and a cleaning device 24*e* While the first transfer charger 24*a* is used to transfer the toner on the photoconductor 2 to the transfer medium 24, the second transfer charger 24*c* is used to transfer the toner on the transfer medium 24 to a copy sheet and the separation charger 24*d* separates the copy sheet from the transfer medium 24. On the other hand, the cleaning device 24*e* removes residual toner on the transfer medium 24.

Figure 5:
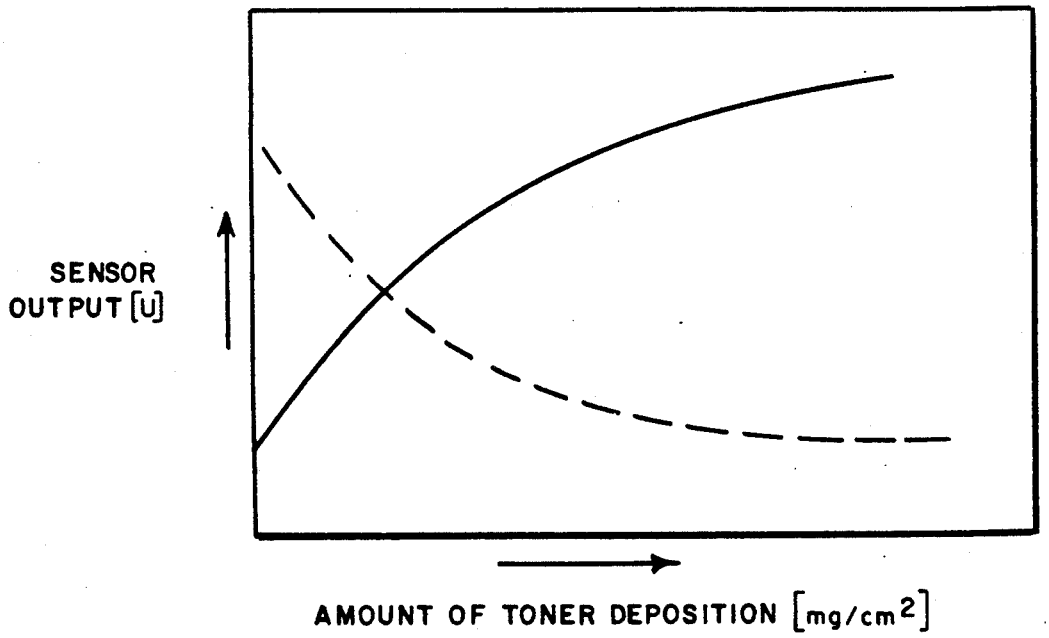
FIG. 5 is a graph showing the characteristic of a toner sensor (toner density detector) employed in the copying machine.
Figure 9:
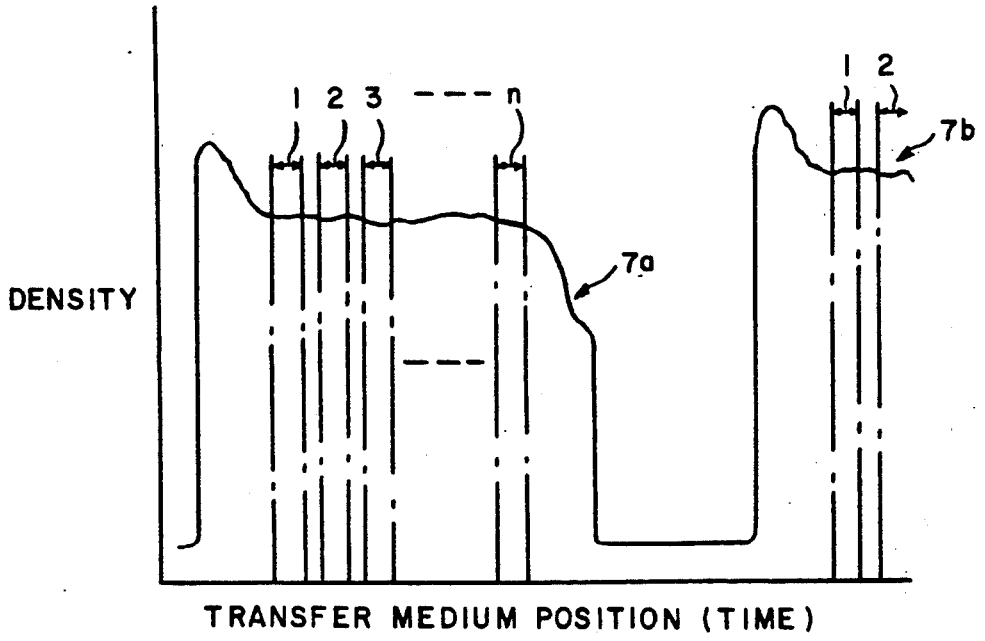
FIG. 9 is a graph illustrating the method of detecting the designated density area by the toner sensor.

On the downstream side of the first transfer charger 24*a*, there is disposed a toner sensor (density detector) 24*b* facing the transfer medium 24. The toner sensor 24*b* consists of a reflecting type photosensor and detects the toner density on the transfer medium 24 as a voltage variation. FIG. 5 shows the characteristic of the toner sensor 24*b*. During the test mode hereinafter described, the toner sensor 24*b* detects the toner densities of designated density areas formed on the transfer medium 24. FIG. 9 is a diagram illustrating how the toner sensor 24*b* detects the toner densities of designated density areas. The solid line in the graph represents the densities of designated density areas 7*a* and 7*b* as well as the density on the transfer medium 24. As shown, the densities of the designated density areas 7*a* and 7*b* are not uniform but variations are observed. In particular, because of the edge effect of an electric field, a larger amount of toner is deposited on the leading edge portion of an image, thereby providing a higher density, while on the trailing edge portion, a lesser amount of toner is deposited, thereby providing a lower density. In inbetween portions of the designated density area 7*a* (7*b*) excluding the leading edge and trailing edge portions of the image, the toner sensor 24*b* takes samplings of the toner density n times. A mean value is obtained from the n toner density samples by a CPU hereinafter described, to determine the toner density.

The designated density areas are formed by applying toner from one of the developing devices 23*a*–23*c* to the uniformly charged photoconductor 2. Three varieties of designated density areas are formed in a single process by changing the charge potential on the photoconductor 2 (the voltage of the main charger 21) in three different levels while the photoconductor 2 completes one turn. These three varieties of density areas are separated from each other by a blank area formed by the blank lamp 22, and the toner density of each designated density area is determined by the charge potential on the photoconductor 2. As shown by the solid line in FIG. 5, with an increase in the amount of toner deposition, the amount of reflection increases, which in turns increases the sensor output. The above description refers to the case in which copying is made using the yellow, magenta, and cyan color toners.

In the case of monochrome copying with black toner, first the uniformly charged photoconductor 2 is developed using, for example, the developer device 23*a* loaded with yellow toner, which means that yellow toner is deposited on the photoconductor 2. As the potential applied at this time, it is desirable to use the potential in the B range shown in FIG. 8. This is to prevent the density of the yellow toner from varying due to changes in the environmental conditions or other factors.

Next, the yellow toner image formed on the photoconductor 2 is transferred to the transfer medium 24 by the charging action of the first transfer charger 24*a*. The transferred toner image consists of four designated density areas (7*a*, 7*b*, 7*c*, 7*d*) of approximately the same density separated from each other by a blank area formed by the blank lamp 22.

Figure 1A:
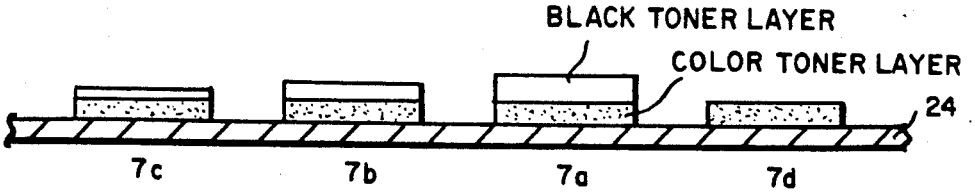
FIGS. 1(A) and 1(B) are cross sectional views of designated density areas, 1(A) for black toner and 1(B) for color toner.
Figure 1B:
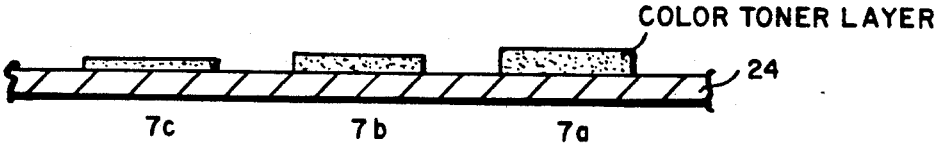

Thereafter, as in the case of other color, the photoconductor 2 charged to three different levels of charge potential is developed by the developing device 23*d* loaded with black toner to form three varieties of designated density areas of black toner. Then, these three varieties of designated density areas of black toner are transferred on top of the yellow toner image on the transfer medium 24. At this time, the black toner areas are superposed on the yellow toner density areas 7*a*–7*c* but not on the area 7*d*. FIG. 1(A) shows a cross sectional view of the designated density areas thus formed.

As shown by the dotted line in FIG. 5, in the thus formed designated density areas of the black toner, with an increase in the amount of black toner deposition, the amount of reflection of the yellow toner underlying it decreases, thereby causing the sensor output to decrease. The situation is the reverse of that observed in the case of the aforementioned color toner. The black toner density is thus detected, and based on the result of the detection, correction is made to decrease the toner density when the toner density is high and to increase it when the density is low.

Figure 8:
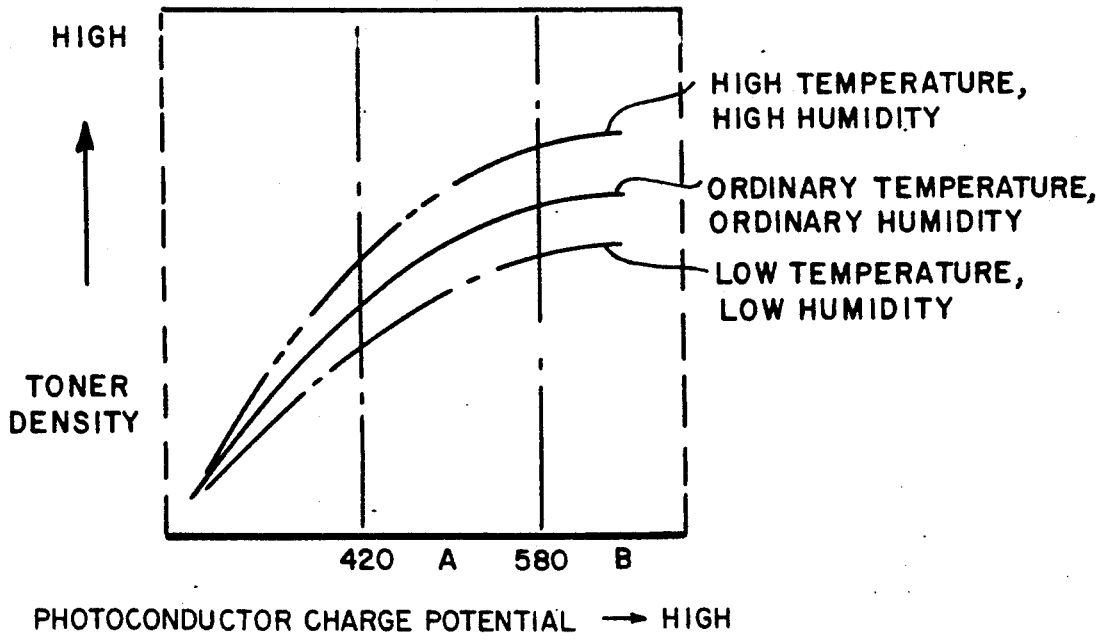
FIG. 8 is a graph showing the relationship between the photoconductor charge potential and the resulting toner density of the designated density area.

FIG. 8 is a graph showing the relationship between the photoconductor charge potential and the toner density of the resulting designated density area. As can be seen from FIG. 8, when the photoconductor charge potential is in the B range, variation in the photoconductor charge potential does not cause any appreciable variation in the toner density since the toner density is in an almost saturated state in that range. On the other hand, when the photoconductor charge potential is in the A range, the toner density varies in accordance with the variation in the photoconductor charge potential. Therefore, when the photoconductor charge potential is set within the A range to form toner layers to be read by the sensor, the toner density can be detected accurately in accordance with the variation in the photoconductor charge potential. However, in the case of a yellow or other color toner formed under black toner, the B range produces a better result. The A range is about 420 to 580 V. In the test mode, three different levels of photoconductor charge potential (voltage of the main charger) are set within this range as process conditions, to form designated density areas. Even when the voltage of the main charger is thus set, the density of the toner deposited on the designated density areas varies due to the photoconductor fatigue, the amount of toner applied from the developing devices, and other factors. Such variation in the toner density is detected by the toner sensor 24*b*. In this embodiment, the photoconductor charge potential is used as the process condition in the test mode, and by detecting the toner density of the designated density areas in the test mode, the photoconductor charge potential can be set as the process condition for the image forming mode. However, in order to produce a better quality image by a copying machine, setting the photoconductor charge potential alone is not enough. Therefore, the exposure amount by a light source lamp in an optical system is also adjusted along with the photoconductor charge potential, which serves to achieve better reproduction of half tone areas in the original. FIG. 8 also shows the relationship between the photoconductor charge potential and the toner density with respect to changes in the ambient temperature and humidity and indicates that even with the constant photoconductor charge potential the toner density of designated density areas (the toner density of the copy image) can change because of a change in the environmental conditions. Therefore, by detecting the toner density of the designated density areas and setting the photoconductor charge potential and other process conditions in accordance with the detected toner density, it is possible to produce a good quality image regardless of changes in environmental conditions.

FIG. 6 (A) is a graph showing the relationship (gamma characteristic) between the original image density and the copy image density when the photoconductor charge potential is varied, and FIG. 6 (B) is a graph showing the relationship (gamma characteristic) between the original image density and the copy image density when the exposure amount by the light source lamp is varied.

Figure 6A:
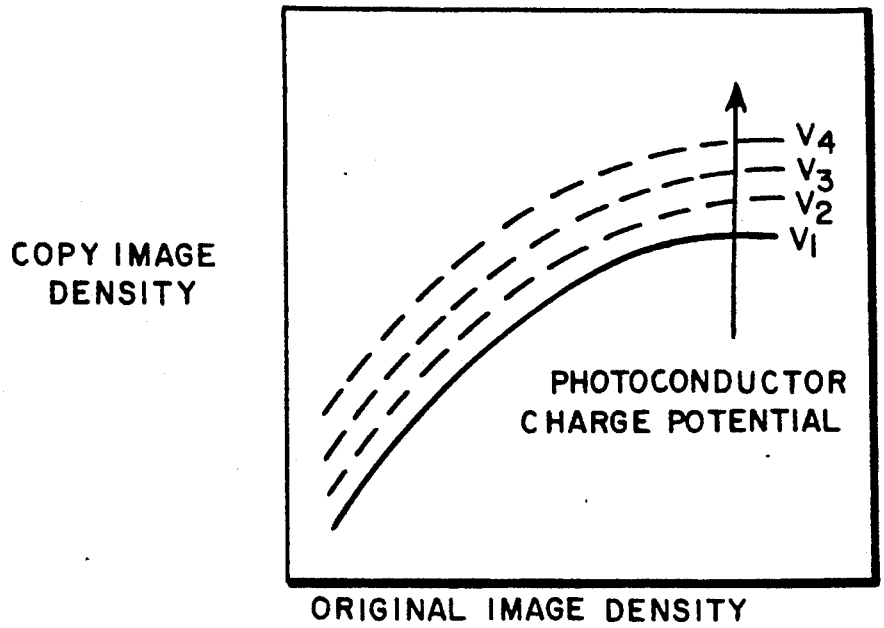
FIGS. 6(A) and 6(B) are graphs respectively showing the change of the gamma characteristic when the photoconductor charge potential is varied and the change of the same when the exposure amount is varied.
Figure 6B:
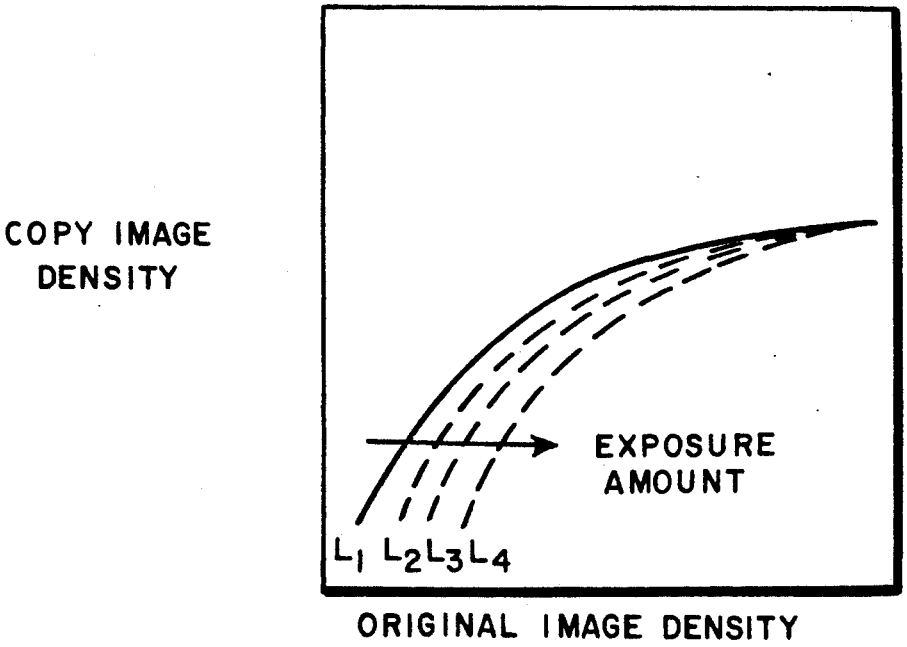

Referring to FIG. 6(A), when the voltage of the main charger is increased, the overall charge potential on the photoconductor increases. Therefore, if the exposure amount is not increased accordingly, the residual potential level (potential at exposed portions) increases, which means an increased density of low density area. The result is a contrasty image. Referring to FIG. 6(B), when the exposure amount of the original is increased, the removed amount of charge on the low density areas in the original remains substantially unchanged, which means that when the amount of exposure is increased, the image density of the low density areas decreases accordingly and the production of a contrasty image is prevented.

Figure 7:
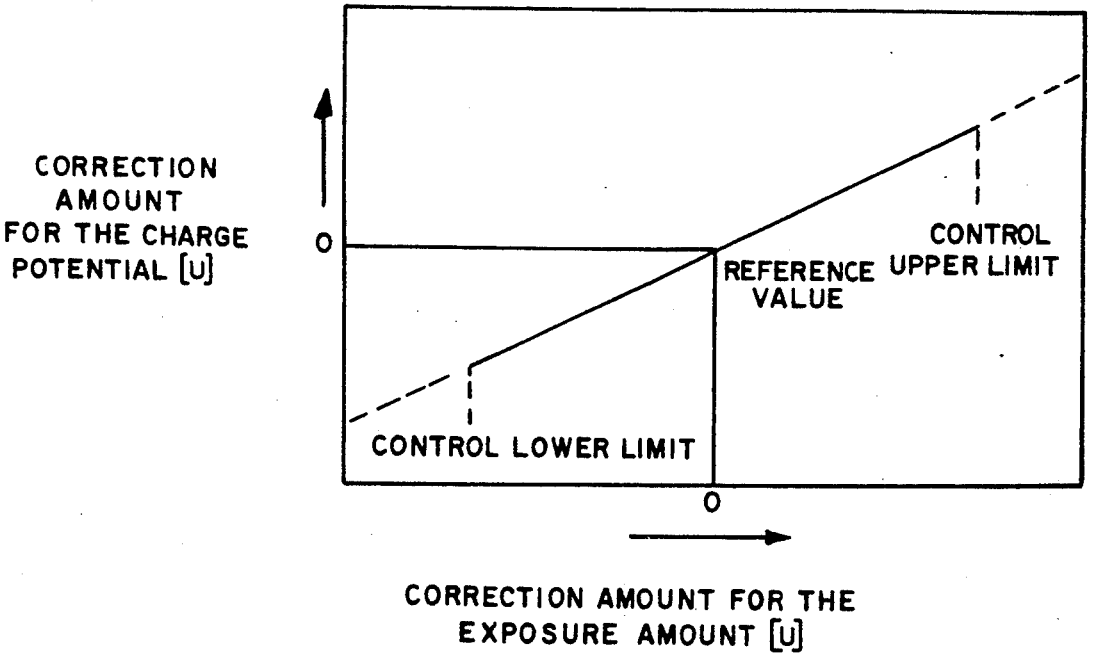
FIG. 7 is a graph showing the relationship between the amount of correction for the photoconductor charge potential and the amount of correction for the exposure amount.

Hence, the relationship between the amount of correction for the photoconductor charge potential and the correction amount for the amount of exposure is obtained, which is shown in FIG. 7. As shown, both correction amounts are substantially proportional to each other. At the initial service stage of the photoconductor, developer, etc., since there is no need to correct the amount of charge or the amount of exposure, the correction amount is zero, which is determined as the reference value.

In the upper part of the copying machine 1, there are disposed a document table 61 and an optical system 6 comprising a light source, mirrors, lens, and color-separation filters. In the copy process of the image forming mode, a document placed on the document table 61 is scanned, and the light reflected from the document is directed to an exposure point P on the photoconductor 2. In the right-hand side of the copying machine 1 is disposed a paper feed section 3 including a paper cassette from which copy paper is fed to the position where the second transfer charger 24*c* is disposed. The second transfer charger 24*c* transfers toner to the paper, and after fixing the toner onto the paper by a fixing device 4, the paper is discharged onto a paper exit tray 5. The fixing device 4 has a heat roller the surface temperature of which is detected by a temperature sensor (not shown) to control the heater. The surface temperature of the heat roller is controlled to one hundred and several tens° C. during operation, and when it is left out of operation for long hours, the surface temperature drops to the level approximately equal to the ambient temperature.

Figure 4:
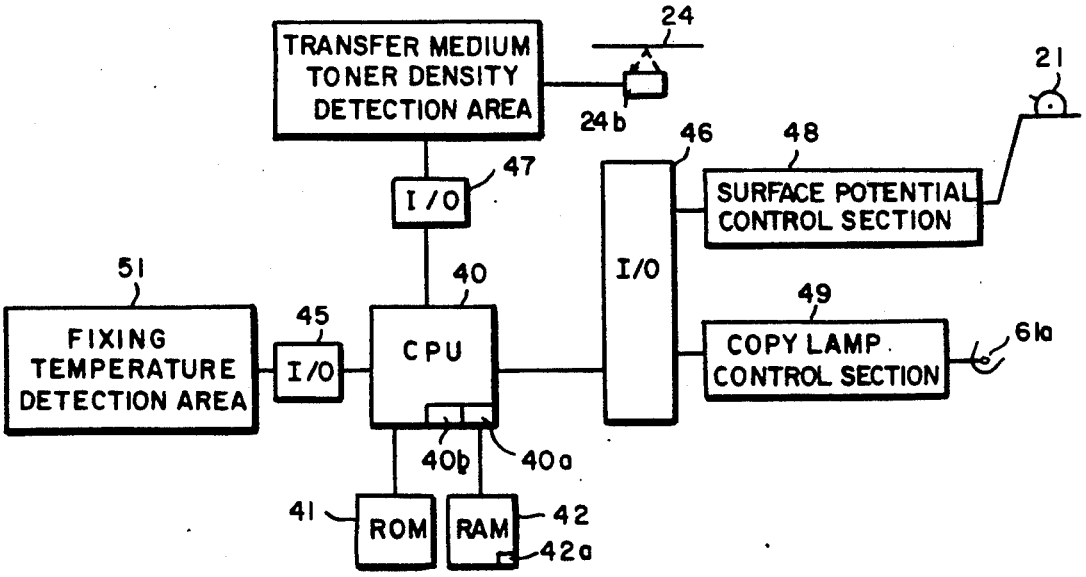
FIG. 4 is a block diagram of the control section of the copying machine.

FIG. 4 is a block diagram showing the control section of the copying machine. The entire operation is controlled by a CPU 40, and programs for CPU processing are contained in a ROM 41. The temperature of the fixing device 4 is input to the CPU 40 via an I/O 45. Also input via the I/O 47 is the detection result of the toner sensor 24*b*. The toner sensor 24*b* takes samplings of the toner density of the designated density area 7*a* (7*b*) n times, as previously described, and supplies the result to the CPU 40. From the n sampling values, the CPU 40 calculates the mean value to determine it as the toner density on the basis of which the CPU 40 determines the charge potential to be applied by the main charger 21 (the photoconductor charge potential) and the exposure amount by the light source 61*a* and supplies the thus determined values to respective control sections 48 and 49 The CPU 40 contains: a toner density comparing/judging means 40*a* for judging the toner density of an image by comparing the toner density detected by the toner density detecting means with the reference value for the toner density; and a toner density correcting means 40*b* for correcting the toner density of the image based on the result of the comparison and judgment by the comparing/judging means. A RAM 42 contains a toner density storing means 42*a* for storing the predetermined toner density reference value.

The relationship between the amount of correction for the charge potential and the amount of correction for the amount of exposure shown in FIG. 7 is stored in the RAM 42; the charge potential and the exposure amount are corrected based on the detection result of the toner sensor 24*b*. The RAM 42 also stores a standard toner density SO for the toner deposited on the transfer medium 24. The standard toner density SO refers to the toner density detected by the toner sensor 24*d* when designated density areas are formed under normal temperature and humidity with the photoconductor charge potential (VD) set to 500 V as the process condition for the image forming mode at the initial service stage of the photoconductor and developer. The standard toner density SO for the black toner is the difference between the sensor detected value of the area 7*d* with no black toner deposition as shown in FIG. 1(A), and that of the designated density area with black toner deposition.

Figure 2:
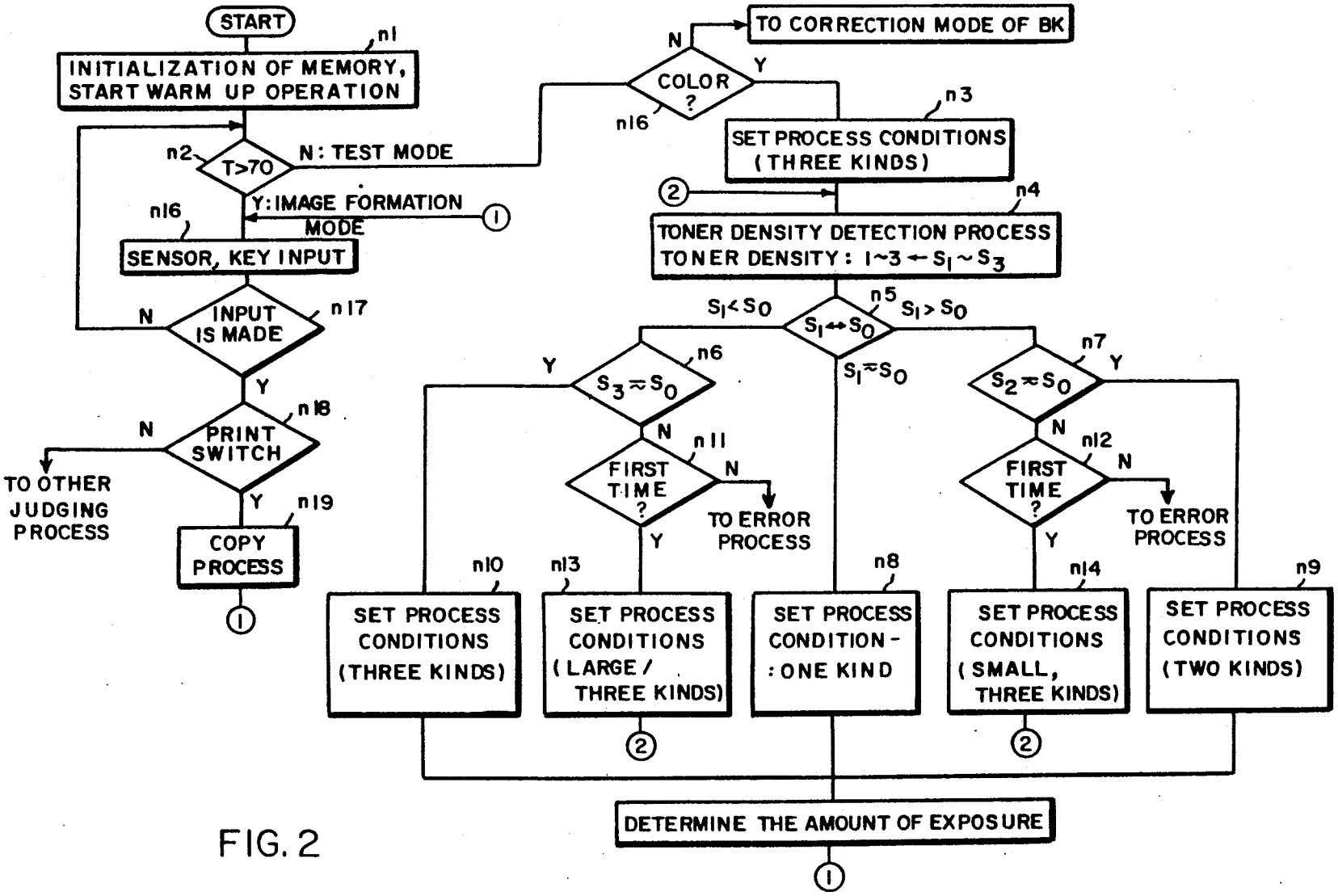
FIG. 2 is a flowchart illustrating the procedure for setting the process condition according to the present invention.

FIG. 2 is a flowchart illustrating the processing procedure, stored in the ROM, for the copying machine.

When power is turned on to the copying machine, the initialization of memory and other preliminary operations are performed in n1 at the same time that the warmup operation (heating) of the fixing device 4 is started. If the temperature T of the fixing device 4 is 70° C. or less, it is determined that the machine has been left out of operation for long hours, and the process proceeds to n3 to enter the test mode in which the photoconductor charge potential (voltage of the main charger) and other parameters are set.

First, in n3, the photoconductor potential VD1–VD3 is set as the process condition for the test mode. The photoconductor potential is set in three different levels, for example, VD1=500 V, VD2=520 V, and VD3=480 V. The values are so set that VD2 provides the largest toner attraction force and VD3 the smallest attraction force with VD1 coming in-between. In n4, using these three different process conditions, the photoconductor is charged and then exposed to the blank lamp 22, forming designated density areas and thus detecting toner densities S1–S3 under the respective process conditions VD1–VD3. Each toner density S1–S3 is determined by taking samples at several points within the corresponding designated density area and obtaining the mean value from these sampling values, as previously described. It is therefore possible to obtain an accurate value without being affected by unevenness in toner deposition or by the edge effect of an electric field.

The toner densities S1–S3 are each compared with the standard toner density SO stored in the RAM 42 (n5, n6, n7) so that the process condition under which the toner density (one of S1–S3) closest to the standard density SO was obtained is determined as the process condition (charge potential) for the image forming mode (n8–n10). However, if none of the obtained toner densities S1–S3 is close enough to the standard toner density SO, process conditions VD1′–VD3′ (n13) that provide larger amounts of toner deposition than the process conditions set in n3 or process conditions VD1″–VD3″ (n14) that provide smaller amounts of toner deposition are set. In this case also, VD2′ or VD2″ are set as the upper limit value and VD3′ or VD3″ as the lower limit value with VD1′ or VD1″ coming inbetween. For example, VD1′ is set to 560 V, VD2′ to 580 V, and VD3′ to 540 V, or VD1″ is set to 440 V, VD2″ to 460 V, and VD3″ to 420 V. Using these three different process conditions, the step of toner density detection is repeated (n4), and if any one of the detected toner densities S1–S3 is found close enough to the standard toner density SO, the process condition (photoconductor charge potential) that provided the closest toner density is set as the process condition for the image forming mode. It should be noted that in the test mode, the surface potential of the photoconductor is set at a slightly lower level, as indicated by the A range in FIG. 8, in order to form designated density areas with densities slightly lower than the saturated density. Therefore, in the actual image forming mode, the charge potential is set at a higher level than the charge potential set in the test mode. The above description has dealt with correction of the toner density for full color copying, but correction of the black toner density can also be applied in the same manner. First, in n16, it is determined if the correction is for black or color. In the case of black toner, the sensor output decreases as the amount of toner deposition increases, therefore, the process proceeds to n6 when S1>SO and to n7 when S1<SO. Thereafter, the same processing as for the color toners is performed. In n15, based on the thus set charge potential and in accordance with the relationship shown in FIG. 7, the exposure amount by the light source lamp in the optical system is determined. If the toner density close enough to the standard toner density SO has not been obtained after the second try to set the process condition, it is determined that an error of some form, such as a charge value error, has occurred, and error processing will be performed.

After the process condition for the image forming mode has been set in the test mode as described above, the process returns to n16 in which the sensors and keys are examined. If any input is detected in n17, processing for that input is performed. On the other hand, if no input is made and the temperature of the fixing device drops to 70° C. or less with no operation performed (n2), the process proceeds to n3 to repeat the above steps for setting the process condition. When the procedure is so constructed that the process condition is set in the test mode with reference to the temperature of the fixing device of 70° C. or less, as described above, the process condition can be set properly considering changes in ambient humidity and other conditions, thereby assuring at all times production of a good quality image. When the detected input is from the print switch (n18), the copy process is performed in n19 with the preset process condition.

Figure 10:
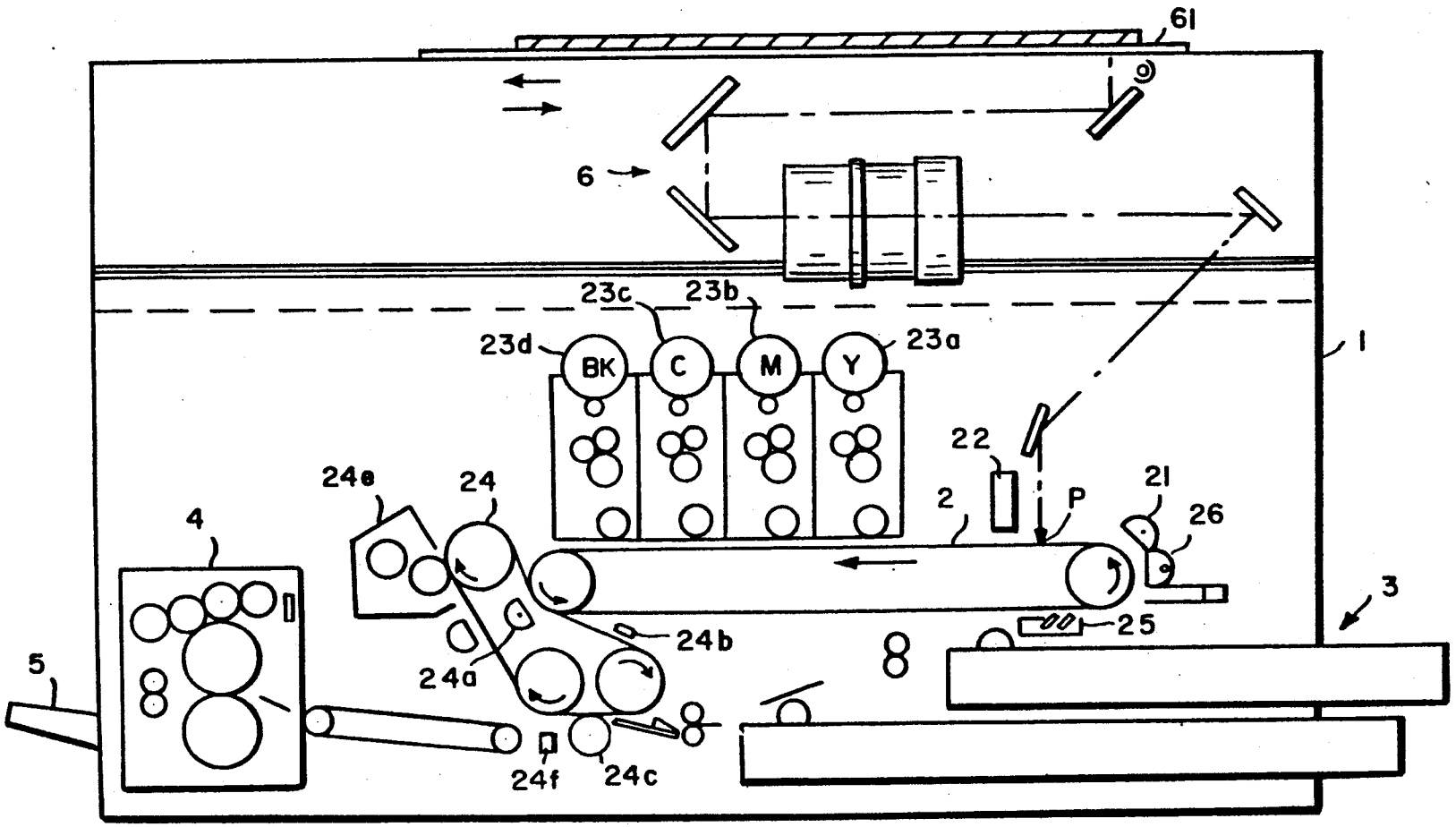
FIG. 10 is a side view of a copying machine in another embodiment of the present invention.

In this embodiment, the black toner layers are formed on the transfer medium when making monochrome copying with black toner, but the construction is not limited to the example given in this embodiment. For example, a transfer roller 24*c* may be used for the purpose, which is disposed facing the transfer medium and in the paper transport path extending from the paper feed section to the fixing section and in which at least toner density detection areas are formed in a non-black color detectable by the toner density detecting means. In this case, a toner sensor 24*f* should be disposed adjacent to the transfer roller 24*c*, as shown in FIG. 10, to detect the toner density for monochrome copying with black toner.

As described, according to the present invention, even small changes in the toner density in the developing device or in the surface potential of the photoconductor manifest themselves in the toner density difference between the designated density areas, regardless of the toner color and even in the case of black toner, and the process condition is set according to the change so that density deviations in image formation can be corrected to detail, thus preventing degradation in the initial image quality and assuring image formation that can cope with photoconductor fatigue and small changes in ambient temperature and humidity. Also, even if there are density variations among the underlying color layers, accurate detection can be accomplished.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. An image density correcting device for a color copying machine capable of producing monochrome copies and full color copies, the device comprising:

a toner density detecting means for detecting the toner density of a toner image transferred on a transfer medium;

a toner density storing means for storing a predetermined reference value for the toner density;

a toner density comparing/judging means for judging the toner density of the image by comparing the toner density detected by the toner density detecting means with said predetermined reference value stored in the toner density storing means; and a toner density correcting means for correcting the toner density of the image based on the result of the comparison and judgment by the comparing/judging means, wherein the toner density is corrected after a black toner layer is formed in any non-black color detectable by the toner density detecting means, when monochrome copies using black toner are produced.

2. An image density correcting device according to claim 1, wherein the black toner layers for monochrome copying with black toner are formed on the transfer medium, and further comprising a pre-toner layer forming means for forming pre-toner layers with a toner of any non-black color detectable by the toner density detection means at least on the toner density detection areas on the transfer medium, followed by the formation of the black toner layers on the top surface of the pre-toner layers formed with the non-black color toner by the pre-toner layer forming means.

3. An image density correcting device according to claim 1, wherein the black toner layers for monochrome copying with black toner are formed on a transfer roller disposed facing the transfer medium and in a paper transport path extending from a paper feed section to a fixing section and in which at least toner density detection areas are formed in a non-black color detectable by the toner density detecting means.

4. A method of correcting the image density in a color copying machine capable of producing monochrome copies and full color copies when monochrome copies using black toner are produced, comprising the steps of:

forming a color toner image on a transfer medium and forming a black toner image on the color toner image;

detecting the toner density of the black toner image;

comparing the toner density of the black toner image to a stored toner density reference value; and correcting the toner density based on the difference between the detected toner density and the toner density reference value.

5. The method of claim 4, wherein the color toner image is yellow.

6. The method of claim 4, wherein the step of correcting includes adjusting exposure intensity.

7. The method of claim 4, wherein the step of correcting includes adjusting charge potential of a photoconductor.

8. The method of claim 4, wherein the step of detecting the toner density of the black toner image includes detecting the amount of light reflected by the color toner image.

9. A method of correcting the image density in a color copying machine having a plurality of developing units when producing monochrome copies using a developing unit, comprising the steps of:

forming a first toner layer on a transfer medium by a developing unit other than the developing unit which is used for the toner for producing monochrome copies;

forming a second toner layer on the first toner layer by the developing unit which is used for producing monochrome copies;

detecting the toner density of the second toner layer;

comparing the toner density of the second toner layer to a stored toner density reference value; and correcting the toner density based on the difference between the detected toner density and the toner density reference value.

* * * * *